United States Patent [19]

Zaterka

[11] Patent Number: 4,545,308

[45] Date of Patent: Oct. 8, 1985

[54] APPARATUS FOR REGULATING AIRFLOW TO A CHEMICAL RECOVERY BOILER

[75] Inventor: Theodore R. Zaterka, South Windsor, Conn.

[73] Assignee: Combustion Engineering, Inc., Windsor, Conn.

[21] Appl. No.: 645,633

[22] Filed: Aug. 30, 1984

[51] Int. Cl.[4] ..... F23L 1/12

[52] U.S. Cl. ..... 110/297; 110/185; 122/379; 126/285 R; 431/153

[58] Field of Search ..... 110/185, 186, 188; 122/10, 23, 379, 503; 126/285 R; 431/153, 154

[56] References Cited

U.S. PATENT DOCUMENTS

| | | | |
|---|---|---|---|
| 1,164,854 | 12/1915 | Oesterlen et al. | 431/153 |
| 2,133,026 | 10/1938 | Henderson | 126/285 R |
| 2,758,637 | 8/1956 | Bergtholdt et al. | 431/153 |
| 4,099,471 | 7/1978 | Sandes et al. | 122/379 |
| 4,477,248 | 10/1984 | Dulac | 110/185 |

*Primary Examiner*—A. Makay
*Assistant Examiner*—Steven E. Warner
*Attorney, Agent, or Firm*—Robert L. Olson

[57] ABSTRACT

A chemical recovery furnace (10) having air nozzles (12) is provided with apparatus (22) for keeping the nozzles clear of combustion product deposits, and also accurately controlling the airflow through such nozzles. Each nozzle has slots (20) in the sidewalls thereof, which slots are of decreasing width, the smallest width (38) being closest to the furnace. A plug (22) is slidable within each nozzle to control airflow, and also remove deposits from within the nozzle.

3 Claims, 5 Drawing Figures

APPARATUS FOR REGULATING AIRFLOW TO A CHEMICAL RECOVERY BOILER

BACKGROUND OF THE INVENTION

In chemical recovery units where black liquor is burned, deposits tend to build up in the air nozzles, which prevent the regulation or control of the air to such nozzles after a period of time. Thus it is necessary to provide scraping or cleaning devices for these nozzles, which are periodically actuated to keep these nozzles or air ports free of built-up deposits. Various arrangements have been used in the past for both cleaning and controlling the airflow to the air nozzles. Most of these have shortcomings in that they are expensive and complicated, or do not clean the nozzles sufficiently to permit accurate control or regulation of airflow thereto.

SUMMARY OF THE INVENTION

In accordance with the invention, an air duct completely encircles a chemical recovery boiler. Positioned within the air duct or chamber are a plurality of air nozzles. Each nozzle has an open inner end opening into the furnace, and an open outer end into which a plug extends. Slots are cut into the sidewalls of the nozzles in such a fashion that as the plug is moved inwardly or outwardly within the nozzle, it accurately controls the amount of airflow into the nozzle through the slots. Such inner and outer movement of the plug also cleans deposits from the air nozzle. Stops on the plug actuator prevent the plug from traveling too far in either direction so as to prevent the plug from being moved completely out of the air nozzle.

DESCRIPTION OF THE PREFERRED EMBODIMENT

Looking now to the drawings, numeral 10 denotes tubes which make up the furnace wall of a chemical recovery boiler. At certain points, these tubes are bent apart so as to permit nozzles 12 to extend into the furnace. The nozzles are supplied with air from duct or chamber 14 (FIG. 1) which extends around the entire periphery of the furnace. Likewise, there are a plurality of nozzles 12 which are equidistantly spaced around the entire periphery of the furnace.

Figure 2:
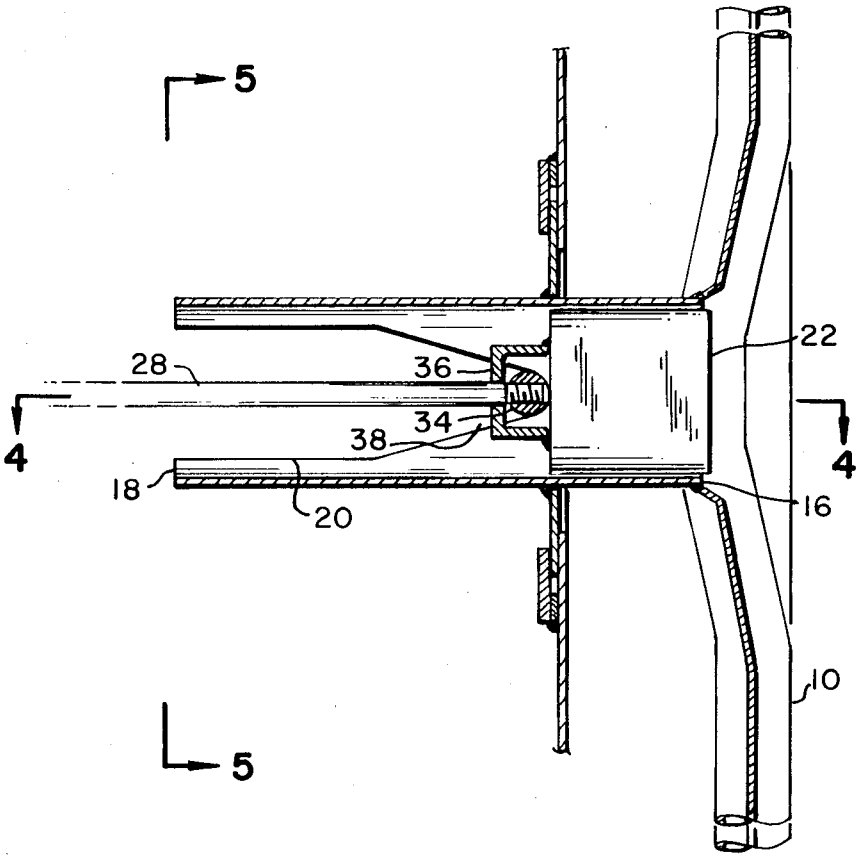
FIG. 2 is an enlarged view of a portion of FIG. 1.
Figure 5:
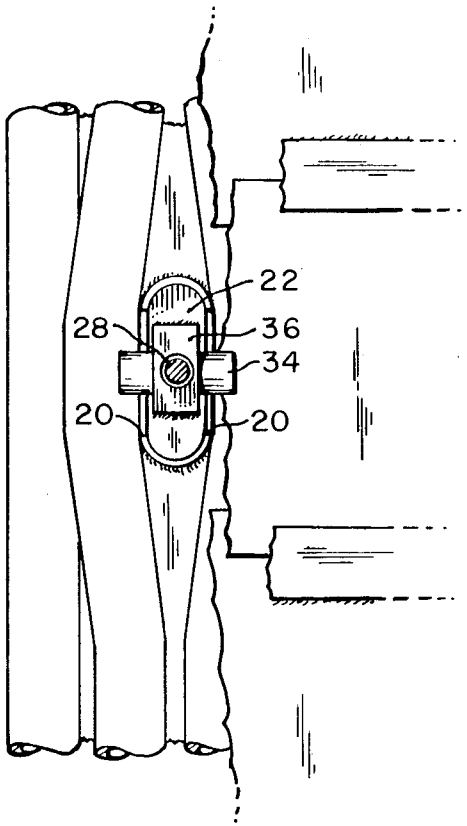
FIG. 5 is a view taken on line 5—5 of FIG. 2.

Each nozzle 12 is open at its inner end 16, and also at its outer end 18. In addition, a pair of slots 20 extend along the sidewalls of each nozzle 12 (FIG. 2). Extending into the outer end of each nozzle 12 is a plug 22. The plug 22 is of such size and configuration that it blocks airflow out of the outer end of nozzle 12 but can slide or be moved forward and backward within the nozzle passage 12. A handle 24 can be actuated either manually or can be motor driven to actuate the plug 22. The handle is pivoted at 26, and is attached to rod 28, which in turn is connected to the plug 22. A stop member 30 is attached to the rod 28, and coacts with the chamber wall 32 to prevent the plug from being completely withdrawn from the nozzle 12. Forward motion of the plug is limited by contact of member 34 with the end of slot 20. The actuating rod 28 is connected to the plug 22 by means of a bar or pin 34 integral with the rod, which is housed within a cage 36, which is attached to the plug (FIG. 2). This somewhat loose connection permits a little relative motion between the two members, which is desirable to help break the plug loose if it becomes frozen into place by a buildup of deposits over a lengthy period of operation.

As best seen in FIG. 2, the slots 20 are V-shaped 38 at their inner end. This permits more accurate airflow control through the slots as the plug 22 is moved towards its closed position.

Figure 1:
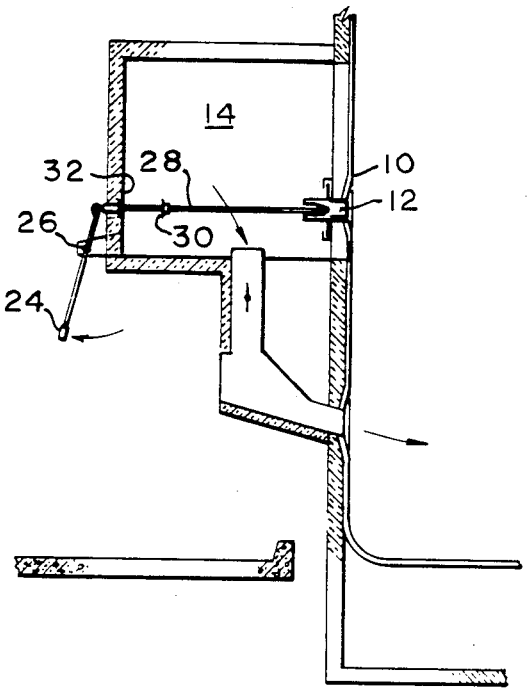
FIG. 1 is a sectional side view of an air nozzle of a chemical recovery boiler.
Figure 3:
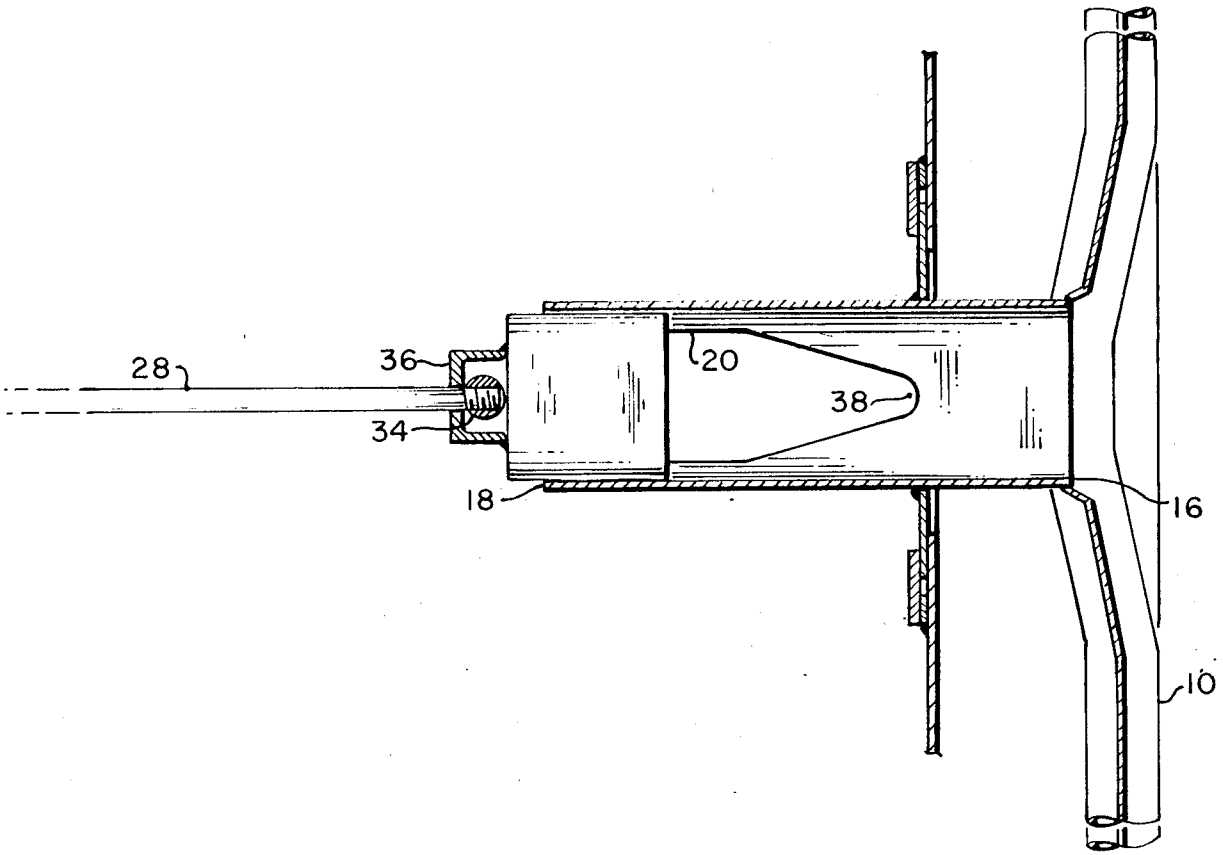
FIG. 3 is the same view shown in FIG. 2, only with the valve in its open position.
Figure 4:
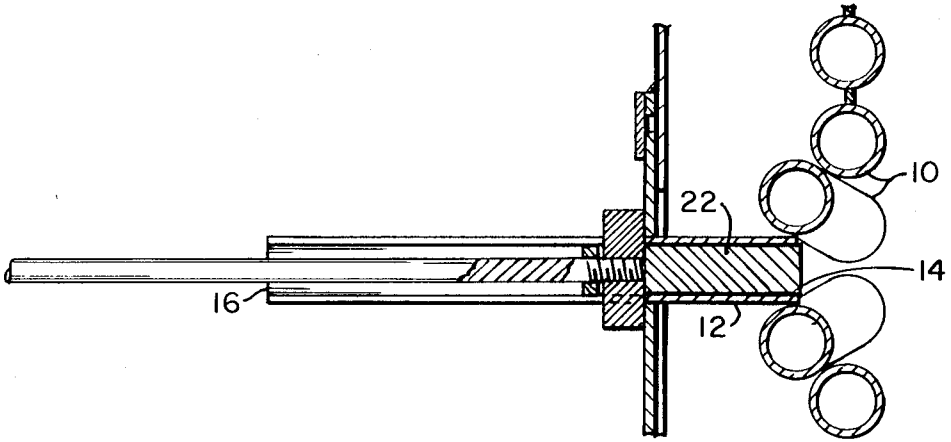
FIG. 4 is a sectional view taken on line 4—4 of FIG. 2.

The operation of the apparatus should now be apparent. During operation of the unit, air is introduced into the duct or chamber 14 (FIG. 1). When it is desired to prevent airflow into the boiler through nozzles 12, the plugs 22 are moved into their closed positions, as shown in FIG. 2. When airflow is desired through the nozzles, the plugs are moved to their open positions, shown in FIG. 3. If something less than full airflow is desired, the position of the plug 22 can be adjusted accordingly. In order to prevent the nozzles from becoming plugged with built-up combustion products from the furnace, the plugs 22 are periodically rocked forward and backward a number of times to dislodge any deposits from the nozzles.

I claim:

1. In combination, walls forming a furnace, a nozzle, air passage means connected to the furnace through the nozzle, said nozzle having an open outer end, and an open inner and slot means formed in the sidewall thereof, a plug positioned within the nozzle, actuating means connected to the plug for moving it toward and away from the furnace, the plug being of such size that it prevents air flow into the outer end of the nozzle, and when the plug is moved to a first position closely adjacent to the furnace it stops air flow through the slot means to the furnace, and when the plug is moved to a second position more removed from the furnace, it allows air flow to the furnace through the slot means, and stop means on the actuating means for preventing the plug from being completely removed from the nozzle.

2. The combination set forth in claim 1, wherein the slot means is of decreasing width, with the smallest width closest to the furnace, so that more accurate airflow control can be maintained when the plug is positioned intermediate its first and second positions.

3. The combination set forth in claim 2, wherein the actuating means is connected to the plug by means of a loose connection which aids in breaking away deposits of combustion products which may form in the nozzle.

* * * * *